US005754110A

United States Patent [19]

Appalucci et al.

[11] Patent Number: 5,754,110

[45] Date of Patent: May 19, 1998

[54] SECURITY TAG AND MANUFACTURING METHOD

[75] Inventors: Lawrence Appalucci, Villanova, Pa.; Luis Francisco Soler Bonnin, Guanica, Puerto Rico; Gary Thomas Mazoki, Sewell, N.J.; Roger Jay Peirce, Langhorne, Pa.; Anthony Frank Piccoli, Audubon, N.J.; Mark James Rankin, Media, Pa.

[73] Assignee: Checkpoint Systems, Inc., Thorofare, N.Y.

[21] Appl. No.: 612,356

[22] Filed: Mar. 7, 1996

[51] Int. Cl.[6] ..... G08B 13/14

[52] U.S. Cl. ..... 340/572; 29/593

[58] Field of Search ..... 340/572; 29/593, 29/602.1; 324/546, 652, 654, 655

[56] References Cited

U.S. PATENT DOCUMENTS 3,913,219 10/1975 Lichtblau ..... 29/592.1
4,369,557 1/1983 Vandebult ..... 340/572 X
5,103,210 4/1992 Rode et al. ..... 340/572
5,182,544 1/1993 Aquilera et al. ..... 340/572
5,276,431 1/1994 Piccoli et al. ..... 340/572

*Primary Examiner*—Thomas Mullen
*Attorney, Agent, or Firm*—Panitch Schwarze Jacobs & Nadel, P.C.

[57] ABSTRACT

A security tag used with an electronic article surveillance system for detecting the presence of the tag within a surveilled area utilizing electromagnetic energy at a frequency within a predetermined detection frequency range includes a dielectric substrate having first and second opposing principle surfaces, a peripheral outer edge, and a resonant circuit capable of resonating at a frequency within the predetermined detection frequency range. The security tag also includes a guard member, in one embodiment a discontinuous conductive member, effectively electrically isolated from the resonant circuit, extending along at least a portion of the peripheral outer edge of the substrate for surrounding at least a portion of the resonant circuit. The guard member electrically isolates the resonant circuit to facilitate testing of the resonant circuit during an early stage of the manufacturing process when the resonant circuit is in web form.

15 Claims, 5 Drawing Sheets

SECURITY TAG AND MANUFACTURING METHOD

FIELD OF THE INVENTION

The present invention relates to security tags for use with electronic security systems for the detection of unauthorized removal of articles and, more particularly, to a resonant tag which is more efficient to produce.

BACKGROUND OF THE INVENTION

Electronic article surveillance (EAS) security systems for detecting and preventing unauthorized removal of articles or goods from retail establishments and/or other facilities, such as libraries, are well known and widely used. In general, such security systems employ a label or security tag which is affixed to, associated with, or otherwise secured to an article or item to be protected or its packaging. Security tags may take on many different sizes, shapes, and forms, depending on the particular type of security system in use, the type and size of the article, etc. In general, such security systems detect the presence of a security tag as the security tag (attached to the protected article) passes through a security or surveillance zone or passes by or near a security checkpoint or surveillance station.

Certain prior art security tags work primarily with radio frequency (RF) electromagnetic field disturbance sensing electronic security systems. Such electronic security systems generally establish an electromagnetic field in a controlled area through which articles must pass when being removed from the controlled premises. A tag having a resonant circuit is attached to each article, and the presence of the resonant circuit in the controlled area is sensed by a receiving portion of the system and an alarm is activated to denote the unauthorized removal of an article. The resonant circuit can be deactivated, detuned, shielded, or removed by authorized personnel from an article authorized (i.e. purchased or checked out) to be removed from the premises, thereby permitting passage of the article through the controlled area without alarm activation.

During the manufacturing process, the RF tag circuits are generally processed in web form and, thereafter, are die cut from the web to form end-to-end strips of individual tags. FIG. 6 shows a portion of a typical web 100 during tag production having a plurality of individual tags 102. The illustrated portion of the web 100 has four rows of tags and four columns of tags. However, an actual production web 100 may have many more than 4 columns of tags. The width of the web 100 may be approximately 8 inches and a finished tag 102 may be approximately 1.5 inches by 1.5 inches. In web form, the resonant circuits of the individual tags 102 are electrically connected to each other and accordingly, at this point in the manufacturing process, do not resonate at the detection frequency. Thus, the resonant frequency of an individual tag 102 may not be tested until after the tag circuit is actually die cut from the web 100 and separated from the other tag circuits of the web 100 considerably later in the manufacturing process.

It would be advantageous to be able to test the resonant frequency of each of the tags 102 at an earlier stage in the manufacturing process and preferably well prior to the point at which the tags 102 are die cut from the web 100. The ability to measure the resonant frequency of the individual tags 100 at such an earlier stage of the process would provide immediate feedback relative to the effectiveness of each subsequent step in the manufacturing process. For example, one step in the process is to weld or connect together the conductive traces on each side of the substrate of a tag 102. When this step is properly performed, the circuit resonates at a particular resonant frequency, preferably at or near the detection frequency of a system with which the tag will be used. If the circuit does not resonate after the weld is performed, this information can be used to adjust the welding process before a large number of tags are processed with bad welds. Furthermore, circuits which resonate outside of the desired frequency range can be rejected or more easily modified at an earlier point in the process, as opposed to at the end of the process, before additional time and materials are spent processing unacceptable tag circuits.

There are several factors in the manufacturing process of current tags that impact the final frequency of the circuit, including the precision of the die cutting of the tags 102 from the web 100 which establishes, in part, the size of the inductor coil of the tag. It is preferable that the RF circuit resonates as close as possible to its predetermined detection frequency (e.g., 8.2 MHz) to enable the antenna of a detection system to discriminate the RF circuit from undesirable noise that may be generated in the operating environment. Thus, the ability to measure the resonant frequency of each tag circuit, early in the manufacturing process and preferably while the tag circuits are still in web form provides immediate feedback that can allow on-line process adjustments to correct the resonant frequency of a circuit which is resonating outside of the predetermined range or to allow for tighter tolerances such that circuits resonate much closer to the resonant frequency than if no such early, on-line adjustments were performed. Accordingly, it would be advantageous to be able to test the resonant frequency of individual tag circuits while the circuits are still in web form.

The present invention provides a guard member which may be a non-conductive member or may be a discontinuous conductive member which extends along a portion and preferably all of the peripheral outer edge of the substrate of each tag and surrounds the resonant circuit. In this manner each tag is electrically separated or isolated from each other when the tags are in web form so that the frequency and other characteristics of each tag may be tested and adjustments made to the tag early on in the manufacturing process and throughout the process if desired. When the tags are die cut from the web, the die cut may be made through a portion of the guard member as opposed to through a portion of the inductor coil as was done with the prior art. This permits greater tolerance with respect to the positioning of the tags for die cutting and provides greater uniformity in the size of the inductor coil, lending to better resonant frequency stability.

SUMMARY OF THE INVENTION

Briefly stated, the present invention comprises a security tag for use with an electronic security system having means for detecting the presence of a security tag within a surveilled area utilizing electromagnetic energy at a frequency within a predetermined detection frequency range. The security tag comprises a dielectric substrate having a first principal surface, a second, opposite principal surface, and a peripheral outer edge. At least one resonant circuit comprising a first conductive pattern is disposed on the substrate first surface and a second conductive pattern is disposed on the substrate second surface. The resonant circuit is capable of resonating at a frequency within the predetermined detection frequency range. A guard member, in a preferred embodiment a discontinuous conductive member, extends along at least a portion of the peripheral outer edge of the substrate and surrounds at least a portion of the resonant circuit. The conductive member is effectively electrically isolated from the resonant circuit and electrically isolates the resonant circuit to facilitate testing of the resonant circuit during manufacturing of the security tag when the resonant circuit in web form.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred, it being understood, however, that the invention is not limited to the precise arrangement and instrumentalities disclosed. In the drawings.

DETAILED DESCRIPTION OF PREFERRED EMBODIMENTS

Figure 1:
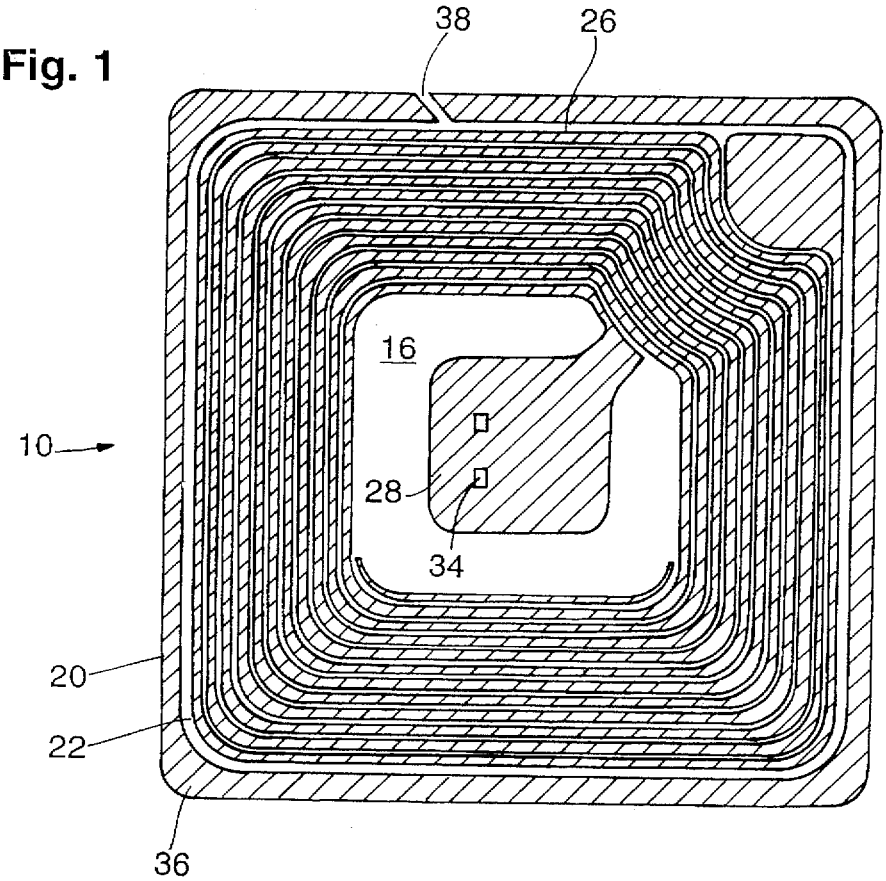
FIG. 1 is an enlarged plan view of a first side of a printed circuit security tag in accordance with a preferred embodiment of the present invention.

Certain terminology is used in the following description for convenience only and is not limiting. The words "top", "bottom", "lower" and "upper" designate directions in the drawings to which reference is made. The terminology includes the words above specifically mentioned, derivatives thereof and words of similar import.

Figure 3:
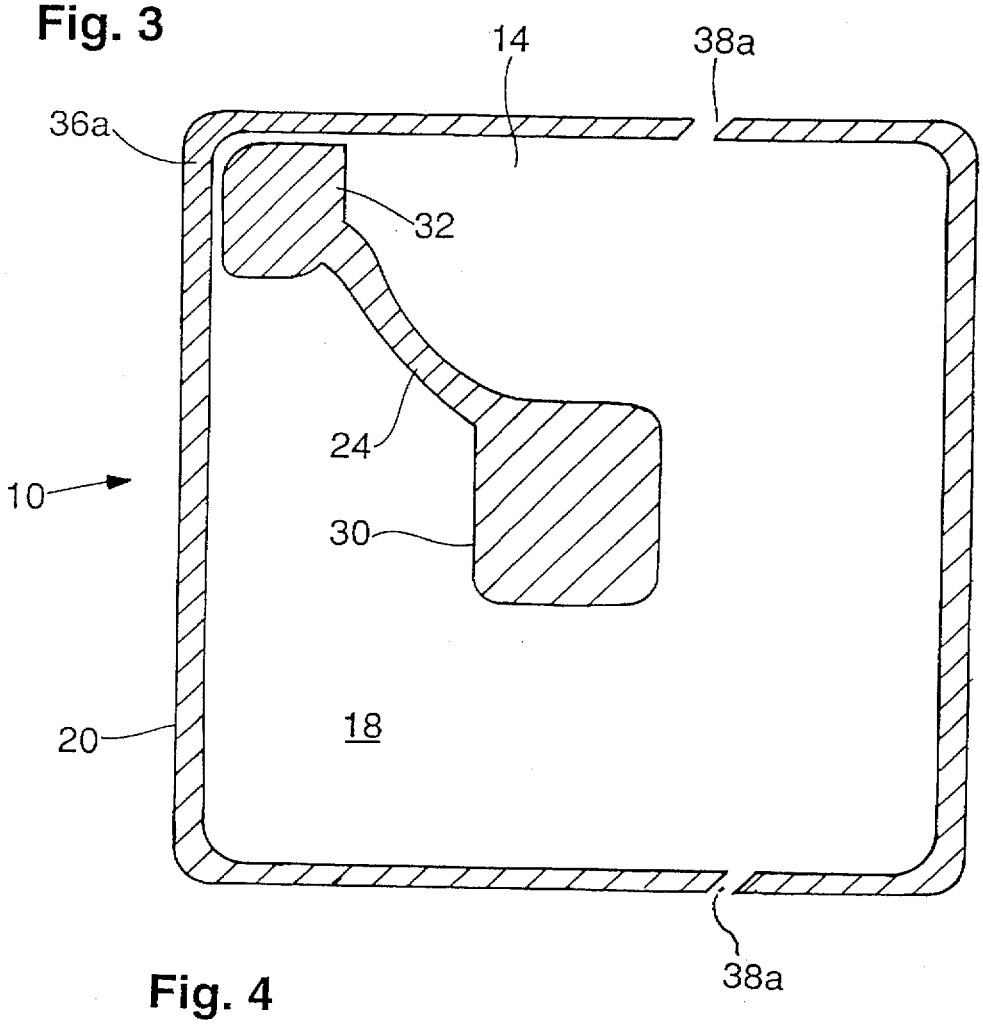
FIG. 3 is an enlarged plan view of a second side of the printed circuit security tag of FIG. 1.
Figure 4:
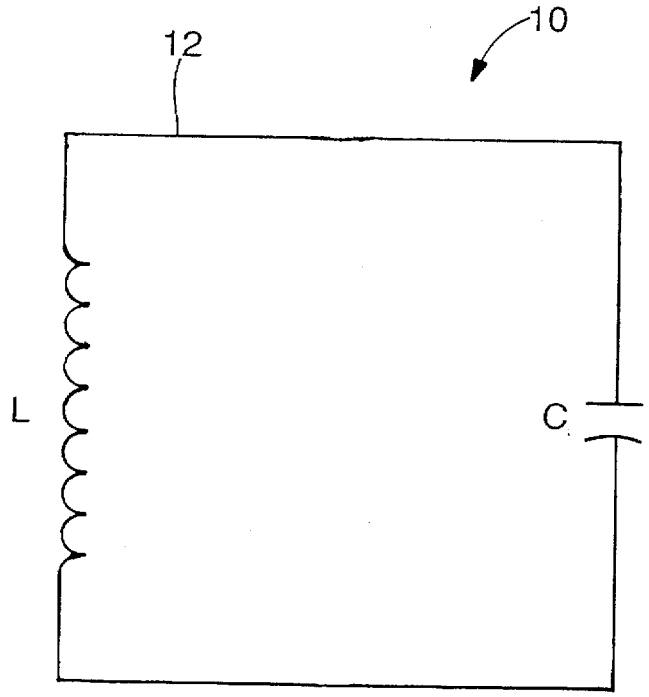
FIG. 4 is an electrical schematic of a resonant circuit used in a preferred embodiment of a security tag of the present invention.

Referring now to the drawings, wherein the same reference numeral designations are applied to corresponding elements throughout the several figures, there is shown in FIGS. 1, 3 and 4 a security tag 10 in accordance with a preferred embodiment of the present invention. With certain exceptions hereinafter described, the tag 10 is generally of a type which is well known in the art of electronic article security systems. As is also well known in the art, the tag 10 is adapted to be secured or otherwise borne by an article or item, or the packaging of such article for which security or surveillance is sought. The tag 10 may be secured to the article or its packaging at a retail or other such facility, or as is presently preferred, secured or incorporated into the article or its packaging, by the manufacturer or wholesaler of the article.

The tag 10 is employed in connection with an electronic article security system (not shown), particularly an electronic article security system of the radio frequency or RF type. Such electronic article security systems are well known in the art and, therefore, a complete description of the structure and operation of such electronic article security systems is not necessary for an understanding of the present invention. Suffice it to say that such electronic article security systems establish a surveilled area or zone, generally proximate to an entrance or exit of a facility, such as a retail store. The security system's function is to detect the presence within the surveilled zone of an article having an active security tag secured thereto or secured to the corresponding packaging.

Referring now to FIG. 4, an electrical schematic diagram of the security tag 10 is shown. In the case of the present embodiment, the security tag 10 includes components, hereinafter described in greater detail, which establish a resonant circuit 12 that resonates when exposed to electromagnetic energy at or near a predetermined detection resonant frequency. A typical electronic article security system employing the tag 10 includes means for transmitting into or through the surveillance zone electromagnetic energy at or near the resonant frequency of the security tag 10 and means for detecting a field disturbance that the presence of an active security tag resonating circuit causes to establish the presence of a security tag 10, and thus a protected article, within the surveillance zone. The resonant circuit 12 may comprise one or more inductive elements electrically connected to one or more capacitive elements. In a preferred embodiment, the resonant circuit 12 is formed by the combination of a single inductive element, inductor, or coil L electrically connected with a single capacitive element or capacitance C in a series loop. Such a resonant circuit is shown and described in detail in U.S. Pat. No. 5,276,431, which is hereby incorporated by reference. The size of the inductor L and the value of the capacitor C are determined based upon the desired resonant frequency of the resonant circuit 12 and the need to maintain a low induced voltage across the plates of the capacitor. In the presently preferred embodiment, the tag 10 preferably resonates at or near 8.2 Mhz, which is one commonly employed frequency used by electronic security systems from a number of manufacturers, although it will be apparent to those of ordinary skill in the art that the frequency of the EAS system may vary according to local conditions and regulations. Thus, this specific frequency is not to be considered a limitation of the present invention.

Although the tag 10 includes a single inductive element L and a single capacitor element C, multiple inductor and capacitor elements could alteratively be employed. For instance, multiple element resonant circuits are well known in the electronic security and surveillance art, such as described in U.S. Pat. No. 5,103,210 entitled "Activatable/Deactivatable Security Tag for Use with an Electronic Security System", which is incorporated herein by reference. The construction of such resonant circuits can be altered through the use of remote electronic devices. Such circuit alteration may occur, for example, at a manufacturing facility or at a checkout counter when a person purchases an article with an affixed or embedded security tag 10, depending upon the intended use of the tag 10. Deactivation of the tag, which typically occurs at the point of sale, prevents the resonant circuit from resonating within the detection frequency range so that the electronic security system no longer detects when the article passes through the surveillance zone of the electronic security system.

FIGS. 1 and 3 illustrate opposite sides or principal surfaces of a preferred physical embodiment of the security tag 10 which is schematically illustrated by FIG. 4. In its preferred embodiment, the tag 10 comprises a generally square, planar insulative or dielectric substrate 14 which is preferably flexible. The substrate 14 may be constructed of any solid material or composite structure of materials as long as the substrate is insulative and can be used as a dielectric. Preferably, the substrate 14 is formed of an insulated dielectric material, for example, a polymeric material such as polyethylene. However, it will be recognized by those skilled in the art that other dielectric materials may alternatively be employed in forming the substrate 14.

The substrate 14 has a first side or principal surface 16 (FIG. 1), a second side or principal surface 18 (FIG. 3), and a peripheral outer edge 20. The circuit elements and components of the resonant circuit 12 are formed on both principal surfaces of the substrate 14 by patterning conductive material. A first conductive pattern 22 is imposed on the first side or surface 16 of the substrate 14 (FIG. 1), which surface is arbitrarily selected as the top surface of the tag 10, and a second conductive pattern 24 is imposed on the opposite or second side or surface 18 of the substrate 14 (FIG. 3), sometimes referred to as the back or bottom surface. The conductive patterns 22, 24 may be formed on the substrate surfaces 16, 18, respectively, with electrically conductive materials of a known type and in a manner which is well known in the electronic article surveillance art. The conductive material is preferably patterned by a subtractive process (i.e. etching), whereby unwanted material is removed by chemical attack after desired material has been protected, typically with a printed on etch resistant ink. In the preferred embodiment, the conductive material is aluminum. However, other conductive materials (e.g., gold, nickel, copper, phosphor bronzes, brasses, solders, high density graphite or silver-filled conductive epoxies) can be substituted for aluminum without changing the nature of the resonant circuit or its operation.

The tag 10 may be manufactured by processes described in U.S. Pat. No. 3,913,219 entitled "Planar Circuit Fabrication Process", which is incorporated herein by reference. However other manufacturing processes can be used, and nearly any method or process of manufacturing circuit boards could be used to make the tag 10.

The first and second conductive patterns 22, 24 establish at least one resonant circuit, such as the resonant circuit 12, having a resonant frequency within the predetermined detection frequency range of an electronic article surveillance system used with the security tag 10. As previously discussed in regard to FIG. 4, the resonant circuit 12 is formed by the combination of a single inductive element, inductor, or coil L electrically connected with a single capacitive element or capacitance C in a series loop. The inductive element L is formed by a coil portion 26 of the first conductive pattern 22. The coil portion 26 is formed as a spiral coil of conductive material on the first principal surface 16 of the substrate 14. The capacitive element C is comprised of a first plate formed by a generally rectangular land portion 28 of the first conductive pattern 22 and a second plate formed by a corresponding, aligned generally rectangular land portion 30 of the second conductive pattern 24. As will be appreciated by those of skill in the art, the first and second plates are generally in registry and are separated by the dielectric substrate 14. The first plate of the capacitor element C, conductive land portion 28, is electrically connected to one end of the inductor coil 26. Similarly, the second plate of the capacitor element C, conductive land portion 30, is electrically connected by a weld connection (not shown) extending through the substrate 14 proximate a land extension 32 on the second side 18 to the other end of the inductor coil 26, thereby connecting the inductive element L to the capacitor element C in series in a well known manner.

As discussed briefly above, the security tag 10 may be deactivated by changing the resonant frequency of the tag 10 so that the tag resonates outside of the predetermined detection frequency or by altering the resonant circuit 12 so that the circuit 12 no longer resonates at all. Some methods require determining the location of the security tag in the secured article and physical intervention, such as physically removing the security tag or covering the tag with a shielding or detuning device such as a metallized sticker. Other methods involve exposing the tag to high energy levels to cause the creation of a short circuit within the tag, thereby altering its resonance characteristics. A short circuit may be created through the use of a weak area designed to reliably change in a predictable manner upon exposure to sufficient energy.

In the presently preferred embodiment, the security tag 10 also includes means for deactivating the tag 10, such as a means for short-circuiting the plates of the capacitor C. In order to facilitate short-circuiting the capacitor C through the application of electromagnetic energy, one or more indentations or "dimples" 34 are placed on either one or both of the rectangular conductive areas 28, 30.

The tag 10 and its alternate embodiments as thus far described are typical of security tags which are well known in the electronic security and surveillance art and have been in general usage. In forming such security tags, the area of the coil 26 and the areas and overlap of the capacitor plates 28, 30 are carefully selected so that the resonant circuit 12 formed thereby has a predetermined resonant frequency which generally corresponds to or approximates a detection frequency employed in an electronic article security system for which the tag 10 is designed to be employed.

Figure 2:
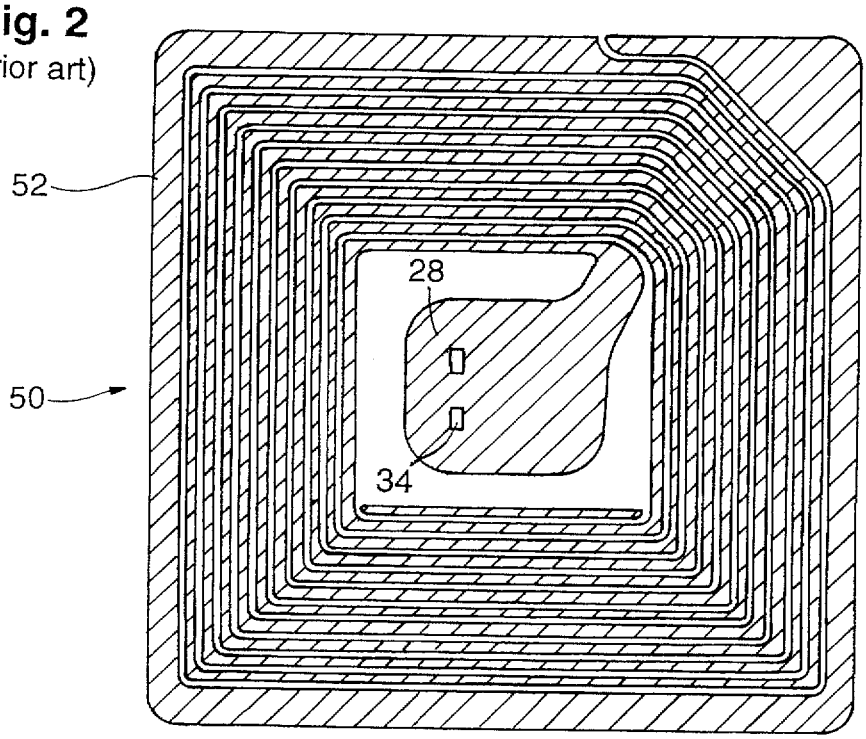
Fig. 2 (Prior art)
FIG. 2 is an enlarged plan view of one side of a prior art printed circuit security tag.

Referring now to FIG. 2, one side of a prior art security tag 50 is shown. The tag 50, like the tag 10, includes a resonant circuit comprising an inductor in the form of a coil 52 and a capacitor located on opposite sides of a substrate. In the prior art, the inductor coil 52 typically extends to and around the peripheral outer edge of the substrate. However, as is readily evident, because the inductor coil 52 extends to and around the peripheral outer edge of the tag 50, when the tag 50 is die cut from the web 100, the positioning of the tag 50 must be very carefully controlled to provide a tag 50 having a coil 52 of the correct size. Any misalignment of the tag 50 at the die cutting step could result in some deviation from the resonant frequency for which the tag 50 was designed.

The present invention provides an electrically discontinuous conductive member or guard rail 36 extending along at least a portion of the peripheral outer edge 20 of the substrate 14 and surrounding at least a portion of the resonant circuit 12. The guard rail 36 may be constructed in the same manner, i.e. by etching, and of the same material as the inductor L. Although it is presently preferred that the guard rail 36 be constructed of a conductive material, it will be understood by those of ordinary skill in the art that the guard rail 36 could be constructed of a nonconductive material (see FIG. 5) which provides a non-conductive barrier between the outer edge 20 of the substrate 14 and the resonant circuit 12 to isolate the resonant circuit 12 from other such circuits when in web form.

U.S. Pat. No. 5,182,544, assigned to Checkpoint Systems, Inc. of Thorofare, N.J. is directed to a particular type of security tag with electrostatic discharge (ESD) protection. The security tag includes a generally continuous (i.e., surrounds the entire tag) conductive frame member on both sides of the tag which is electrically connected to the resonant circuit through a frangible connection means. The frame member temporarily connects together the opposing plates of each of the capacitors of the tag circuit for maintaining all of the capacitor plates at the same electrical potential and thereby preventing a static charge from discharging through the capacitors during manufacture, shipment and storage of the tag. When the security tag is to be used, the connection between the capacitor plates is broken. The frame member continues to be in electrical contact with the capacitor plates located on the inductor side of the tag even after the frangible connection has been broken.

As opposed to the aforementioned U.S. Pat. No. 5,182,544 which teaches providing a continuous conductive member around the outer edge of a security tag which connects together the plates of a capacitor, the conductive member 36 of the tag 10 of the present invention is not electrically connected to the resonant circuit 12 and does not electrically connect together the plates of the capacitor C. Rather, the conductive member 36 acts as a guard rail, surrounding the circuit 12. Accordingly, no beam or connection to the circuit need be broken prior to use of tag 10.

Since the inductor coil 26 on the substrate first side 16 is closer to the edge 20 of the tag 10 than the capacitor plate 30 on the substrate second side 18, in the presently preferred embodiment, the conductive member 36 is located principally on the inductor side, i.e. the first side 16 of the substrate 14. However, it will be apparent to those of ordinary skill in the art that a conductive member 36*a* (see FIG. 3) may be disposed on the opposite side 18 of the substrate 14, or on both sides of the substrate 14. One or more gaps or discontinuities 38 (or 38*a*) are provided in the conductive member 36 (or 36*a*) such that the conductive member 36 is disposed around only a portion of the peripheral edge 20 of the substrate 14. Although the size of the discontinuity 38 may vary, the discontinuity should be large enough to provide for a clean discontinuity in the conductive member 36 (or 36*a*) after the etching process. In the presently preferred embodiment, the conductive member includes one discontinuity 38 which is approximately 0.02 inches wide, but it could be greater or less in some applications. The conductive member 36 is also spaced from the inductor coil 26 such that the conductive member 36 is electrically isolated from the resonant circuit 12, in the present embodiment preferably at least 0.02 inches. However, even though the conductive member 36 is spaced from the inductor coil 26, it will be recognized by those of skill in the art that there may be some inductive coupling between the conductive member 36 and the coil 26.

Figure 5:
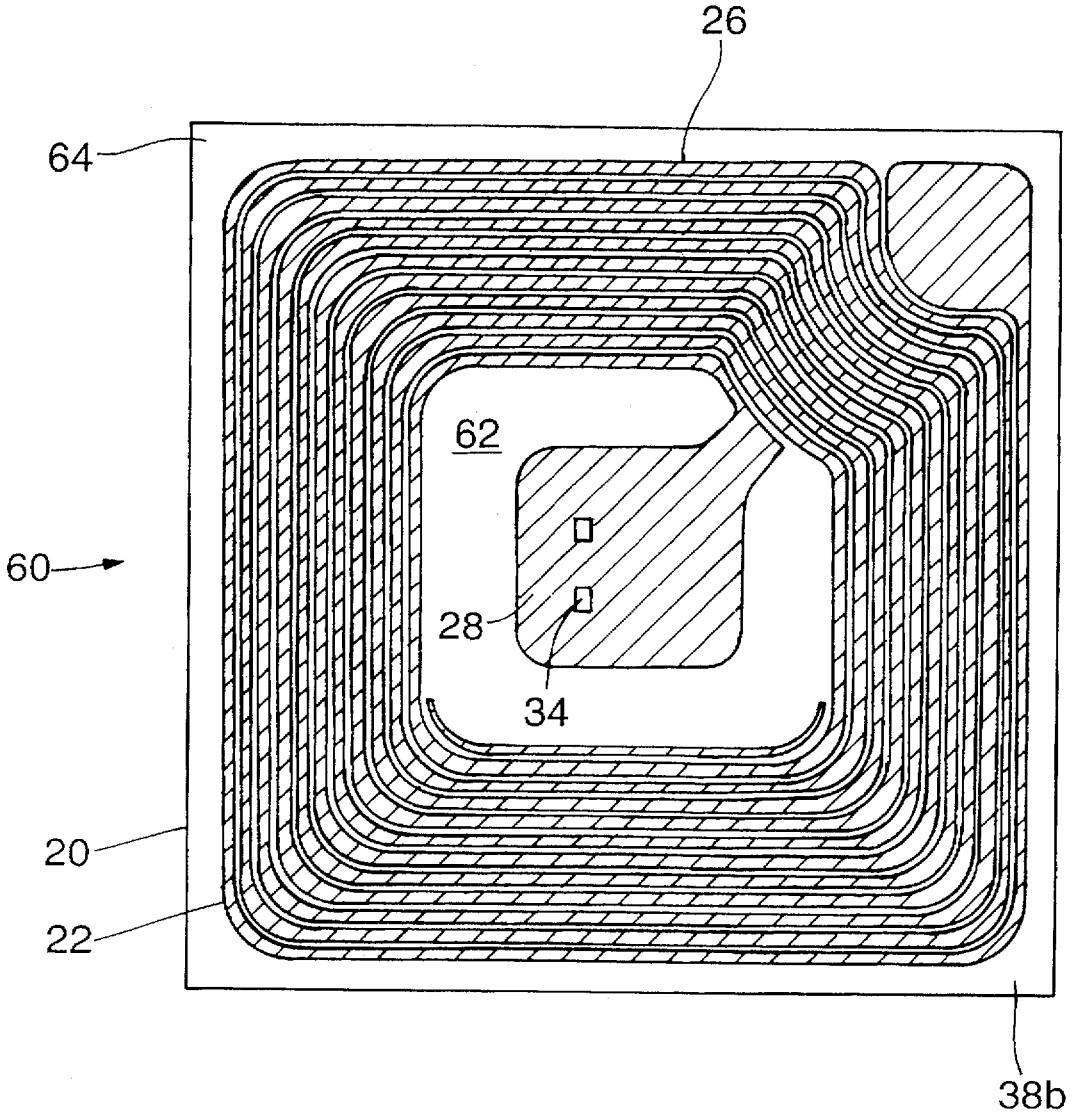
FIG. 5 is an enlarged plan view of a first side of a printed circuit security tag in accordance with an alternate embodiment of the present invention.
Figure 6:
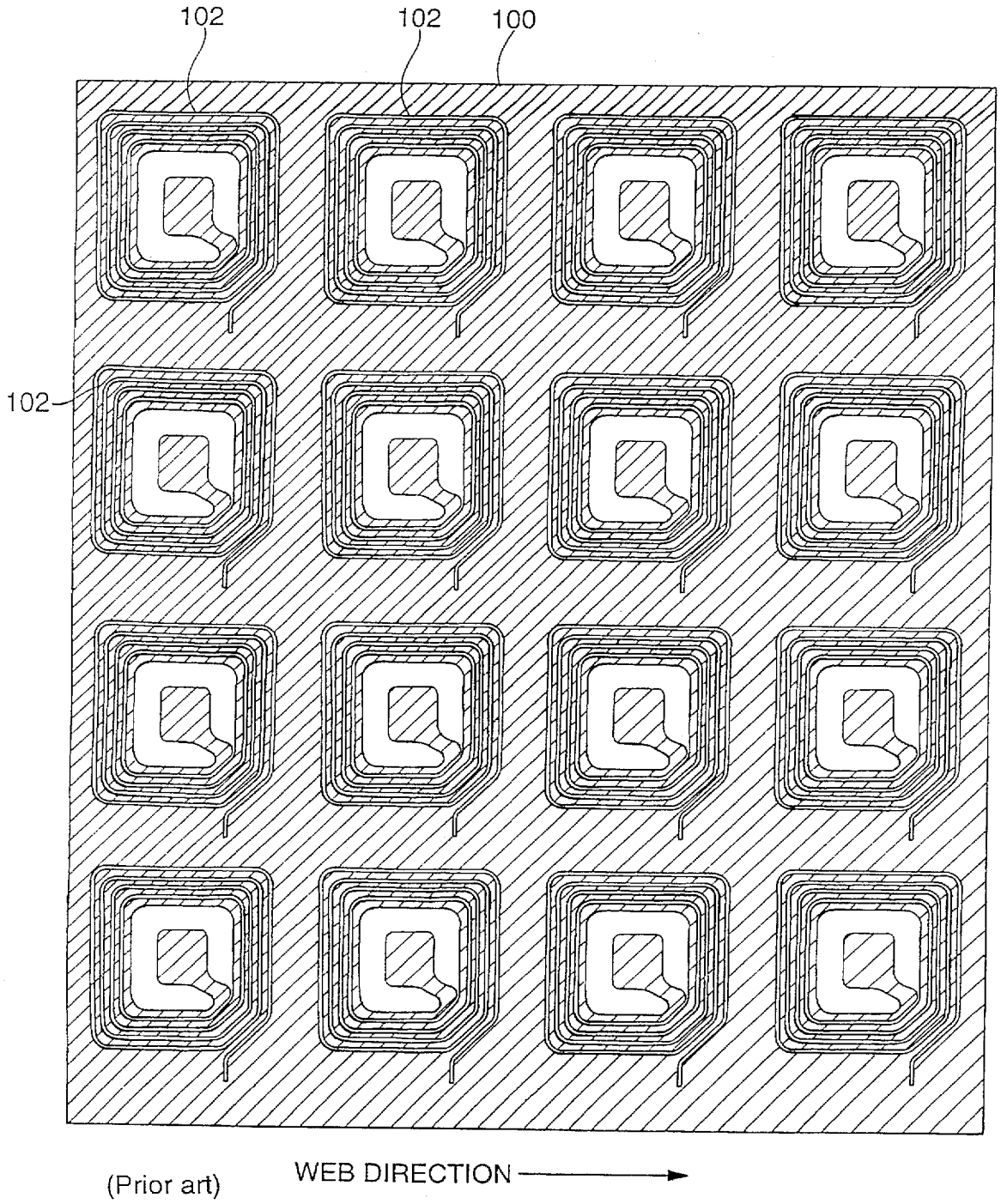
(Prior art) Fig. 6
FIG. 6 is a plan view of one side of a prior art web of printed circuit security tags.

Referring to FIG. 5, an alternate embodiment of a security tag 60, which is schematically illustrated by FIG. 4, is shown. Similar to the tag 10, the tag 60 comprises a generally square, planar insulative or dielectric substrate 62 which is preferably flexible and constructed of the same materials as the substrate 14. The substrate 62 has a first side or principal surface 64, a second side or principal surface (not shown), and a peripheral outer edge 20. The circuit elements and components of the tag 60 are the same as for the tag 10, and are formed on both principal surfaces of the substrate 62 by patterning conductive material. A first conductive pattern 22 is imposed on the first side or surface 64 of the substrate 62, which surface is arbitrarily selected as the top surface of the tag 60, and a second conductive pattern (not shown) is imposed on the opposite or second side or surface of the substrate 62, which is preferably the same as the conductive pattern 24 shown in FIG. 3). The tag 60 is similar to the aforementioned tag 10 in all respects except that the tag 60 does not include a conductive member 36 surrounding the peripheral outer edge 20. Instead, the tag 60 includes a non-conductive guard member 38*b* which preferably comprises the same material as the substrate 62. Thus, the substrate 62 of the tag 60 includes a non-conductive barrier between the outer edge 20 of the substrate 62 and the resonant circuit 12.

Figure 7:
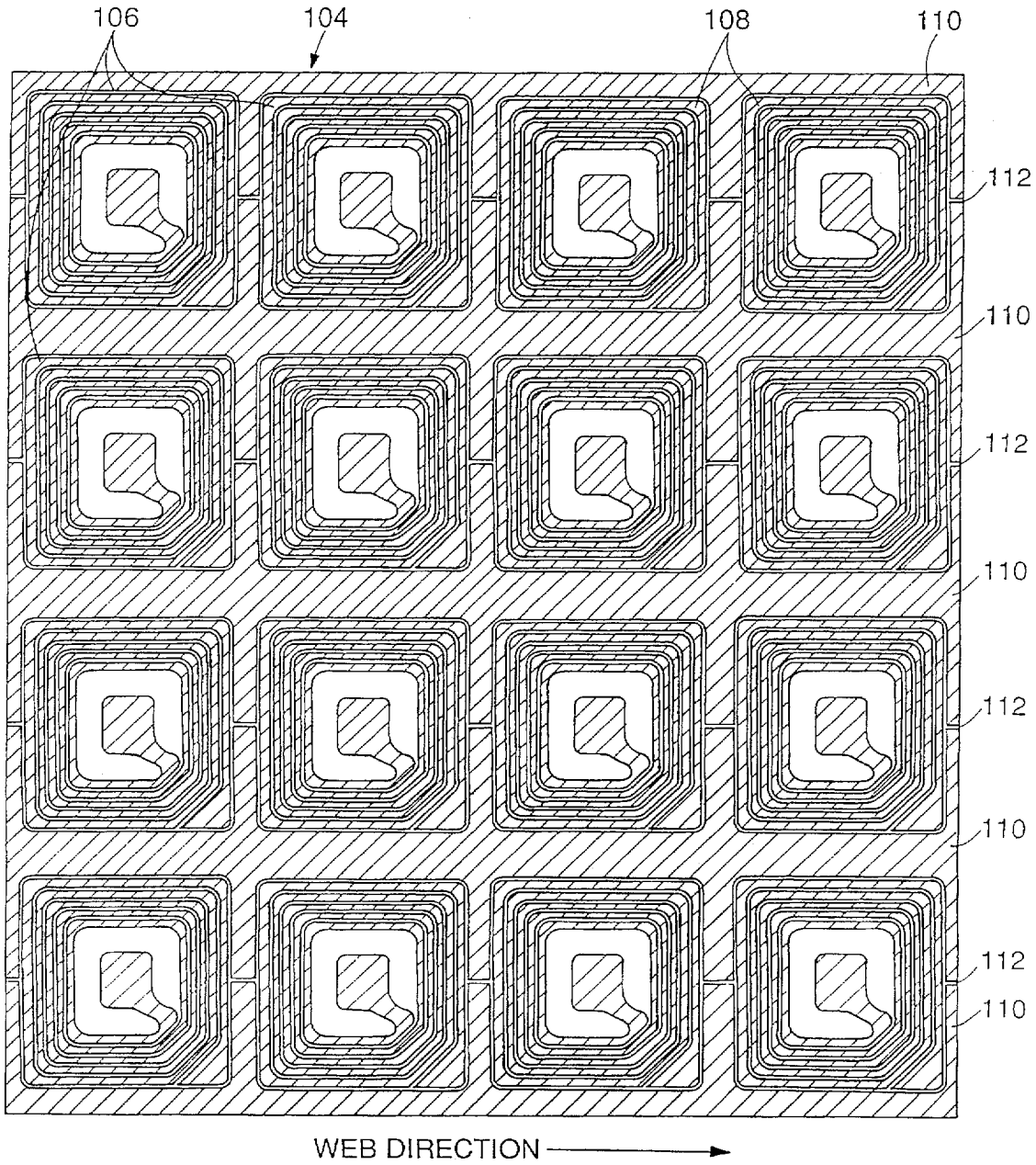
FIG. 7 is a plan view of one side of a web of printed circuit security tags in accordance with a preferred embodiment of the present invention.

As previously discussed, the security tags 10 of the present invention are processed in web form. Referring now to FIG. 7, a web 104 having a plurality of security tags 106 thereon is shown. Generally, a web 104 comprises four rows of tags and a plurality of columns of tags (four columns are shown). In order to allow each of the individual circuits on the web 104 to be tested prior to die cutting or otherwise physically separating the tags 106 from each other, the present invention electrically isolates each of the tags 106 from each other. That is, the conductive traces (the cross-hatched portions shown are conductive) of each of the individual circuits are electrically insulated from the other circuits in the web 104. In the present invention, the conductive material surrounding an outer trace 108 of each of the individual circuits is etched away. A remaining portion of conductive material 110 that surrounds the individual isolated circuits is made discontinuous by etching or forming a discontinuity 112 in the conductive material 110 at each circuit in the web 104. Further, the conductive traces 22 on the first side of the substrate 14 are electrically connected to the conductive traces 24 on the opposite side of the substrate 14. Electrically isolating the resonant circuits while the circuits are still in web form allows each individual circuit to be tested prior to die cutting the tags, thereby allowing significant advantages over prior art manufacturing methods. At the end of the circuit forming process, subject to the size of the die cut, a security tag 10 having a discontinuous conductive guard rail 36 (see FIG. 1) may be formed.

Security tags 10 made in accordance with the present invention are preferably formed end to end in elongated strips. The first side 16 is typically coated with an adhesive for use in attaching the security tags 10 to articles or packaging, and a protective release sheet (not shown) is applied over the adhesive. (The tag 10 is peeled off of the release sheet when ready to be affixed to an article). A paper backing (not shown) is applied by an adhesive to the second side 18 of the tags 10.

From the foregoing description, it can be seen that the present embodiment comprises a security tag for use with an electronic security system. It will be recognized by those skilled in the art that changes may be made to the above-described embodiment of the invention without departing from the inventive concepts thereof. It is understood, therefore, that this invention is not limited to the particular embodiment disclosed, but is intended to cover any modifications which are within the scope and spirit of the invention as defined by the appended claims.

We claim:

1. A security tag for use with an electronic security system having means for detecting the presence of a security tag within a surveilled area utilizing electromagnetic energy at a frequency within a predetermined detection frequency range, the security tag comprising:

a dielectric substrate having a first principal surface, a second, opposite principal surface, and a peripheral outer edge;

at least one resonant circuit comprising a first conductive pattern disposed on the substrate first surface and a second conductive pattern disposed on the substrate second surface, the resonant circuit capable of resonating at a frequency within the predetermined detection frequency range; and an electrically discontinuous conductive member extending along at least a portion of the peripheral outer edge of the substrate and surrounding at least a portion of the resonant circuit, the conductive member being effectively electrically.

2. The security tag as recited in claim 1 wherein the first conductive pattern comprises an inductive element and the conductive member is disposed on the first surface of the substrate.

3. The security tag as recited in claim 2 wherein the conductive member is disposed on both the first and second surfaces of the substrate.

4. The security tag as recited in claim 1 wherein the conductive member includes at least one gap for making the conductive member discontinuous, wherein the at least one gap is at least 0.02 inches wide.

5. The security tag of claim 1 wherein the resonant circuit comprises etched aluminum foil on each principal surface of the substrate.

6. The security tag of claim 1 wherein the conductive member comprises etched aluminum foil.

7. The security tag of claim 1 wherein the conductive member is spaced from the resonant circuit by a predetermined distance sufficient for electrical isolation.

8. The security tag of claim 7 wherein the predetermined distance comprises at least 0.02 inches.

9. A security tag for use with an electronic security system having means for detecting the presence of a security tag within a surveilled area utilizing electromagnetic energy at a frequency within a predetermined detection frequency range, the security tag comprising:

a dielectric substrate having a first side, a second, opposite side, and a peripheral outer edge;

at least one resonant circuit comprising a first conductive pattern disposed on the substrate first side and a second conductive pattern disposed on the substrate second side, the resonant circuit capable of resonating at a frequency within the predetermined detection frequency range; and a guard member disposed along at least a portion of the peripheral edge of the substrate and surrounding at least a portion of the resonant circuit to electrically isolate the resonant circuit, wherein the guard member comprises a conductive material.

10. The security tag as recited in claim 9 wherein the guard member is discontinuous and is effectively electrically isolated from the resonant circuit.

11. The security tag as recited in claim 9 wherein the guard member is composed of the same material as the resonant circuit.

12. The security tag of claim 9 wherein the guard member is disposed on the first side of the substrate.

13. The security tag of claim 12 wherein the guard member is disposed on both the first side and the second side of the substrate.

14. The security tag of claim 9 wherein the guard member includes at least one gap such that the guard member is electrically discontinuous.

15. The security tag of claim 14 wherein the at least one gap is at least 0.02 inches wide.

* * * * *

UNITED STATES PATENT AND TRADEMARK OFFICE

CERTIFICATE OF CORRECTION

PATENT NO. : 5,754,110
DATED : May 19, 1998
INVENTOR(S) : Lawrence Appalucci et al.

It is certified that error appears in the above-identified patent and that said Letters Patent is hereby corrected as shown below:

Column 9,
Line 5, after the word "electrically" insert the words -- isolated from the resonant circuit --

Signed and Sealed this

Twenty-second Day of March, 2005

JON W. DUDAS
*Director of the United States Patent and Trademark Office*